US007849795B2

(12) United States Patent
Sasaki

(10) Patent No.: US 7,849,795 B2
(45) Date of Patent: Dec. 14, 2010

(54) APPARATUS FOR ADJUSTING GRIPPER-BASE HEIGHT OF SHEET-FED PRINTING PRESS

(75) Inventor: Seiji Sasaki, Shizuoka (JP)

(73) Assignee: Shinohara Machinery Co., Ltd., Shizuoka-Shi (JP)

( * ) Notice: Subject to any disclaimer, the term of this patent is extended or adjusted under 35 U.S.C. 154(b) by 560 days.

(21) Appl. No.: 11/998,962

(22) Filed: Dec. 3, 2007

(65) Prior Publication Data

US 2008/0148976 A1 Jun. 26, 2008

(30) Foreign Application Priority Data

Dec. 6, 2006 (JP) ..... 2006-329082

(51) Int. Cl.
*B41F 21/00* (2006.01)

(52) U.S. Cl. ..... 101/409; 101/246

(58) Field of Classification Search ..... 101/230, 101/232, 246, 408, 409; 271/82, 277, 314
See application file for complete search history.

(56) References Cited

U.S. PATENT DOCUMENTS 2,865,289 A * 12/1958 Fowlie et al. ..... 101/409
4,667,952 A * 5/1987 Jeschke et al. ..... 271/277
5,063,843 A * 11/1991 Becker ..... 101/183
5,826,510 A * 10/1998 Haupenthal ..... 101/415.1
6,186,499 B1 * 2/2001 Gross ..... 271/277
6,283,467 B1 * 9/2001 Iida ..... 271/82

FOREIGN PATENT DOCUMENTS

JP 8-29586 3/1996
JP 2779136 5/1998

* cited by examiner

*Primary Examiner*—Ren Yan
(74) *Attorney, Agent, or Firm*—Ladas & Parry LLP

(57) ABSTRACT

The present invention aims at full-automatic adjustment apparatus for gripper-base height in regularly engaging condition without clutch means.

Apparatus according to the invention comprises operation shaft 28 which is co-centered with cylinder axis 16 and is movable in the axial direction of cylinder; the shaft being equipped with rack portion 32 at optional position in the axial direction of cylinder and rotation engagement portion 36 at the extruded end from cylinder axis; adjustment shaft 54 which is rotary provided at the optional position in the axial direction of cylinder to the radial direction and is rotated upon receiving the force from the rack portion 32; the shaft 54 being connected by way of rotation displacement means 58 to gripper-base 22 which is adjustably provided in the radial direction; and drive means 44 which is connected to said rotation engagement portion 36 and moves said operation shaft 28 in the axial direction of cylinder.

3 Claims, 6 Drawing Sheets

APPARATUS FOR ADJUSTING GRIPPER-BASE HEIGHT OF SHEET-FED PRINTING PRESS

BACKGROUND OF THE INVENTION

1. Field of the Invention

The present invention relates generally to sheet-fed printing press, or more precisely, to apparatus for adjusting gripper-base height of sheet transfer cylinder in compliance with sheet thickness.

2. Description of the Prior Art

In a sheet feeder unit or printing units of sheet-fed printing press, there are many sorts of sheet transfer cylinders such as intermediate cylinder or perfecting cylinder and gripper-base must be provided at the circumference of cylinders for gripping and transferring sheets with grippers which are driven harmoniously.

In accordance with the change of sheet thickness to be printed, height of gripper-base which is a receiver of grippers must be adjusted and, if not adequately adjusted, fatal printing impediments such as register error or fan-out will inevitably be caused.

Apparatus for adjusting gripper-base height is disclosed in Japanese patent No. 2779136 in which an adjustment shaft is moved in a radial direction of cylinder by a motor disposed at the end of cylinder axis by way of clutch means in order to shift a slide wedge which is parallel to the cylinder axis. But, as such clutch means is interposed, it is difficult to recognize level position of height adjustment by the technique. In addition, such slide wedge narrowly allows very strict manufacturing precision, and on top of that, fine height adjustment is difficult.

In Japanese published patent application No. 29586/1996, plurality of gripper-bases provided at the circumference of the cylinder are adjusted all together by adjustment discs on both sides of the cylinder. But, start point of adjustment is restricted only from both sides of cylinders by the technique, therefore, scattering of adjustment is caused due to bending of members and the technique is substantially a manual operation.

SUMMARY OF THE INVENTION

Upon consideration of the above-mentioned problems of prior art techniques, the present invention aims at providing an improved full-automatic adjustment apparatus in regularly engaging condition without clutch means. It is another object of the invention to set the start point of height adjustment at will in the direction of cylinder axis. Further object of the invention is to obtain the apparatus which is easy for manufacturing and suitable for fine adjustment.

To achieve the objects, apparatus according to the invention comprises: operation shaft which is co-centered with cylinder axis and is movable in the axial direction of cylinder; the shaft being equipped with rack portion at optional position in the axial direction of cylinder and rotation engagement portion at the extruded end from cylinder axis; adjustment shaft which is rotary provided at the optional position in the axial direction of cylinder to the radial direction and is rotated upon receiving the force from the rack portion; the shaft being connected by way of rotation displacement means to gripper-base which is adjustably provided in the radial direction; and drive means which is connected to said rotation engagement portion and moves said operation shaft in the axial direction of cylinder.

By adopting these constructions, full automation of height adjustment can be realized in regularly engaging condition without any clutch means.

The above and other objects of the invention will become apparent from the following description of preferred embodiment taken in conjunction with the accompanying drawings. However, the following description is only an embodiment of the invention and the present invention is not limited to the embodiment.

DESCRIPTION OF THE PREFERRED EMBODIMENT

An embodiment of apparatus for adjusting gripper-base height according to the present invention will be detailed herein-under with reference to the accompanying drawings.

As is already mentioned, sheet transfer cylinder 10 with apparatus for adjusting gripper-base height according to the present invention may be sheet transfer cylinder of feeder unit or intermediate cylinder and perfecting cylinder of printing units. Generally speaking in sheet-fed printing press, the diameter of such sheet transfer cylinder 10 is equal or multiple (for example twice) to that of plate cylinder, therefore, in such multiple case, a number of gripper-base bars 12 to be adjusted by the present invention will evenly be provided at the circumference of sheet transfer cylinder 10.

Figure 1:
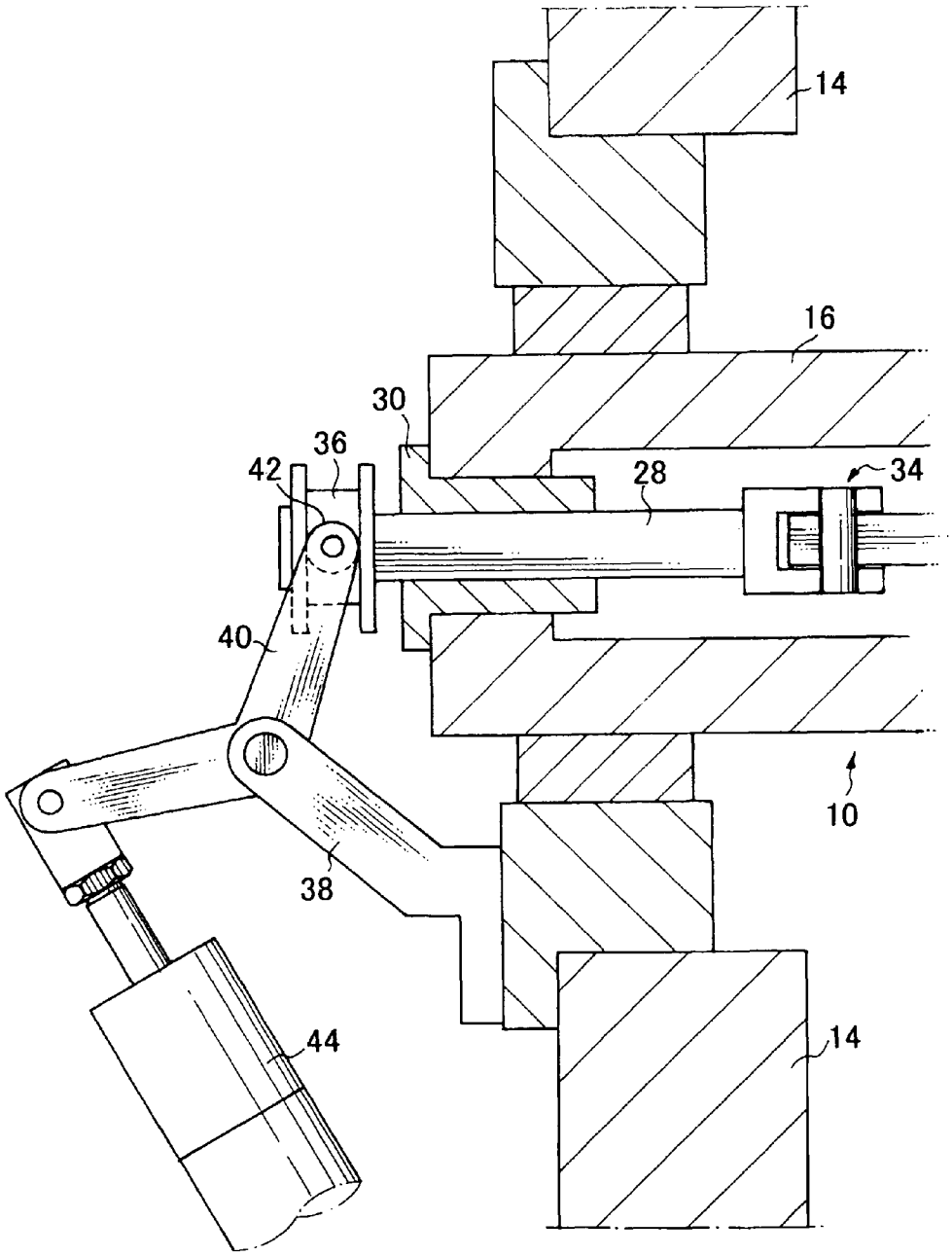
FIG. 1 is a cross-sectional view showing left-half of apparatus for adjusting gripper-base height according to the present invention.

As shown in FIG. 1, cylinder axis 16 of sheet transfer cylinder 10 is freely supported between side frames 14 of both sides of sheet-fed printing press and is harmoniously driven by drive source of printing press through various gear connections.

Figure 3:
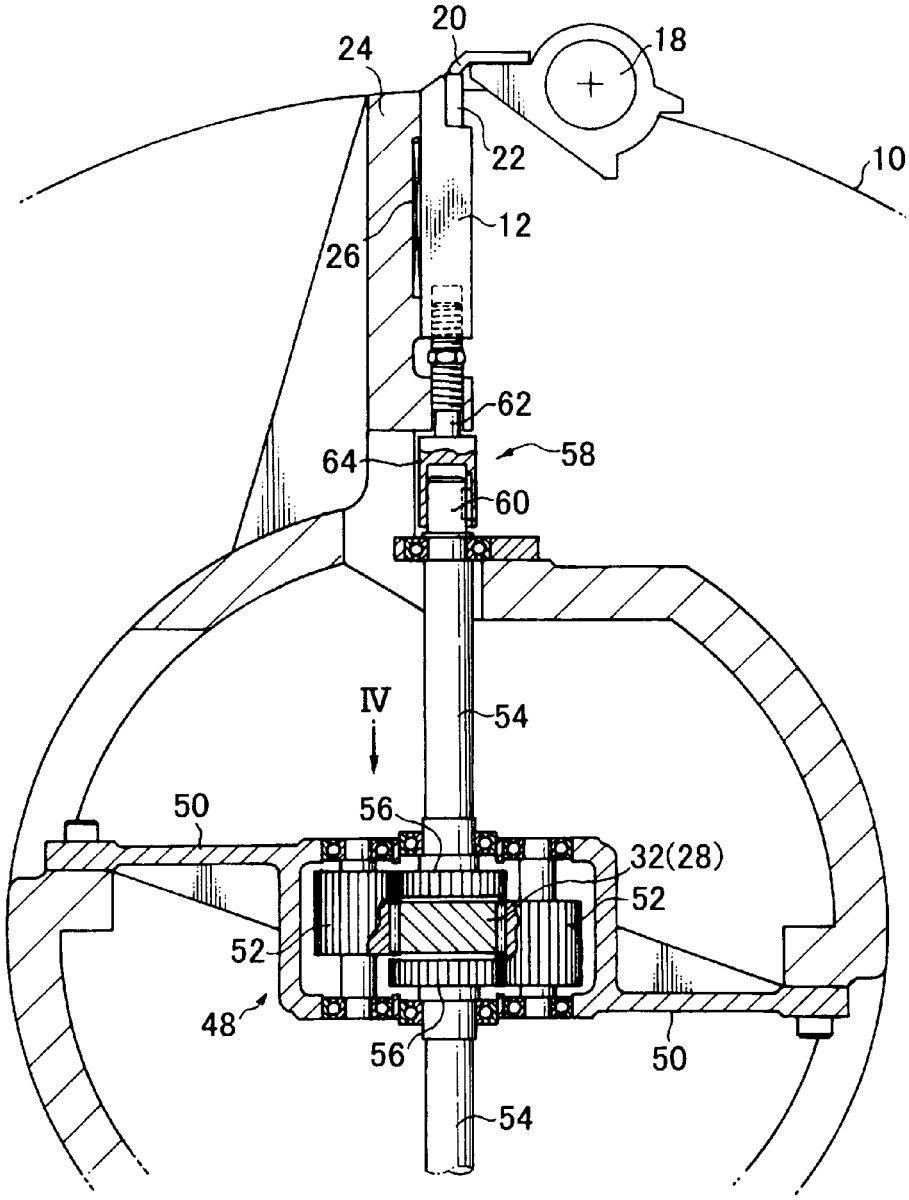
FIG. 3 is a cross-sectional view from an arrow III in FIG. 2.

In FIG. 3, gripper axis 18 is provided in parallel to the center of cylinder at a groove-like cut portion on the circumference of sheet transfer cylinder 10 and numbers of grippers 20 are aligned on the gripper axis 18. Many gripper-bases 22 for receiving these grippers 20 are fixed on gripper-base bar 12 in order to grip sheet end. Accordingly, gripper-base bar 12 is also a long member in parallel to the center of cylinder and height of it is to be adjusted in the radial direction of cylinder (vertical direction of FIG. 3) along wall surface 24 of groove-like cut portion with the aid of bearing member 26 by, for instance, flat roller.

Figure 2:
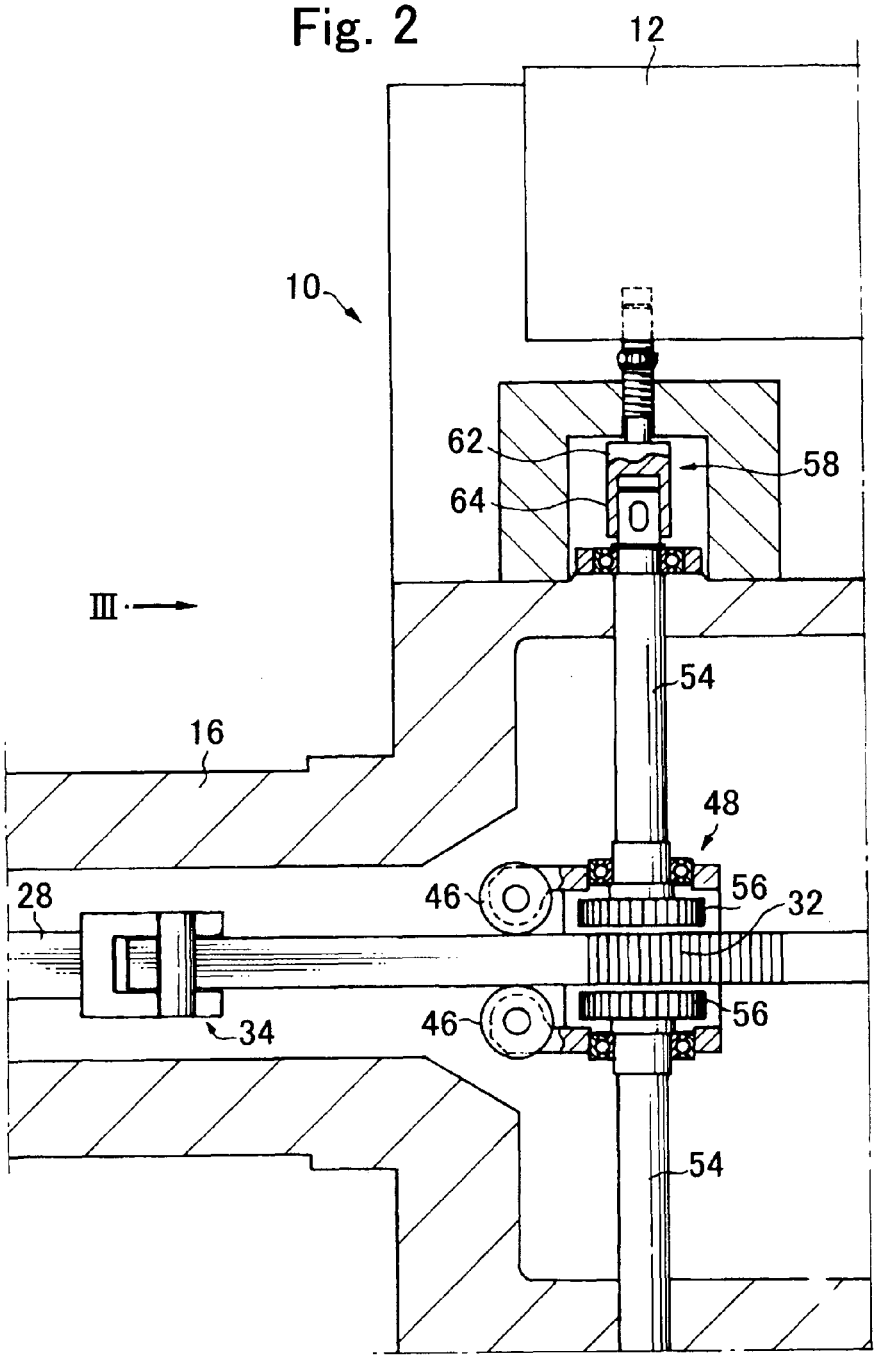
FIG. 2 is also a cross-sectional view showing right-half of apparatus in succession to that of FIG. 1.
Figure 5:
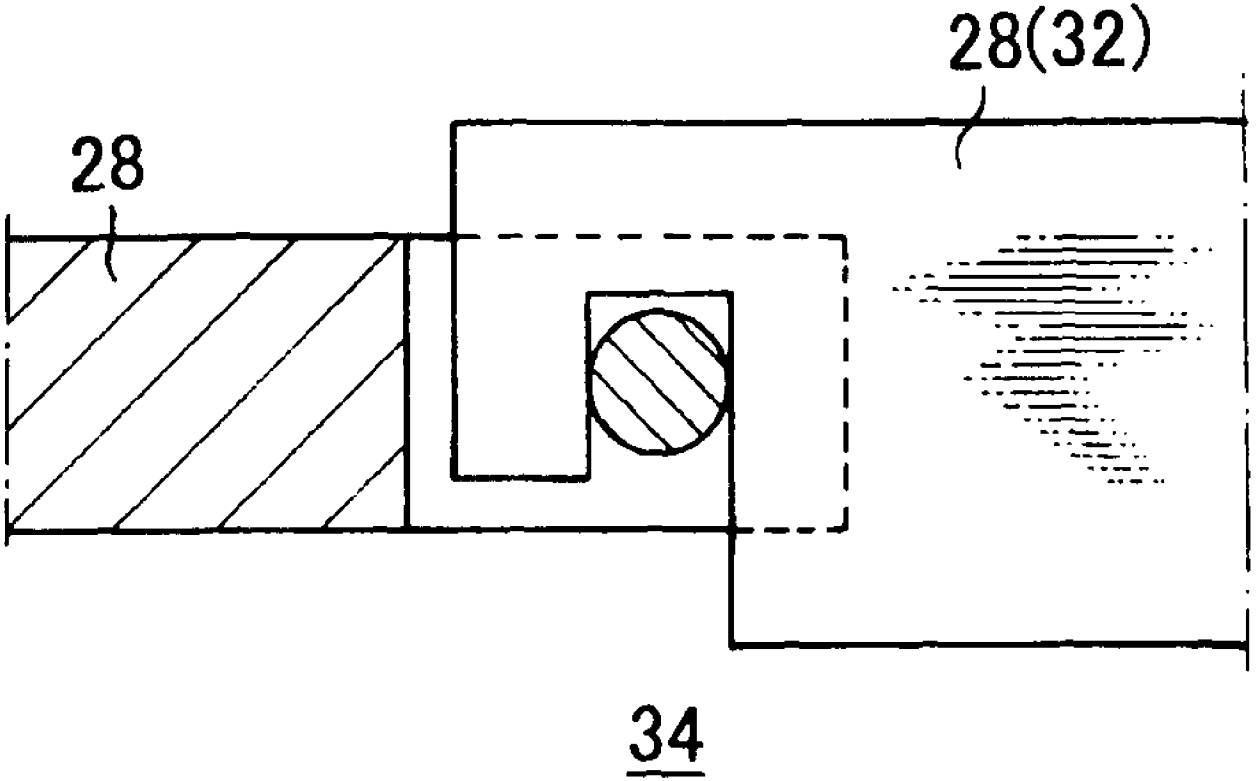
FIG. 5 is also a plan view showing an example of coupling portion of operation shaft.

The center of cylinder axis 16 and cylinder itself is hollow and linear operation shaft 28 is movably supported by bearing 30 in the axial direction of cylinder (horizontal direction of FIGS. 1 and 2). The operation shaft 28 which is co-centered with cylinder axis 16 is formed in the shape of rack 32 at optional position in the axial direction of cylinder and ordinal round-shaft portion is connected by coupling 34. FIG. 5 is a plan view showing a simple example of such coupling portion 34 in which round-shaft and rack portion 34 of linear operation shaft 28 is connected by projection and cut. Such coupling portion 34 is prepared on the way of operation shaft 28, not only for the convenience of manufacturing, but also for preventing curvature and bending which are supposed to be generated especially on the rack portion 34 of long operation shaft 28.

As shown in FIG. 1, rotation engagement portion 36 by circular groove is provided at the extruded end of operation shaft 28 from cylinder axis 16. Crank arm 40 is supported swing-free by a bracket 38 which is fixed to side frame 14. Roller 42 on one end of crank arm 40 engages with rotation engagement portion 36 and, to the other end of crank arm 40, drive means 44 such as by air cylinder or motor is connected.

Operation of drive means 44 may be step-wise or step-less, but ordinarily step-wise operation may be preferred, as sheet thickness to be printed is grouped and accordingly, amount of height adjustment for gripper-base is divided into some classes.

Figure 4:
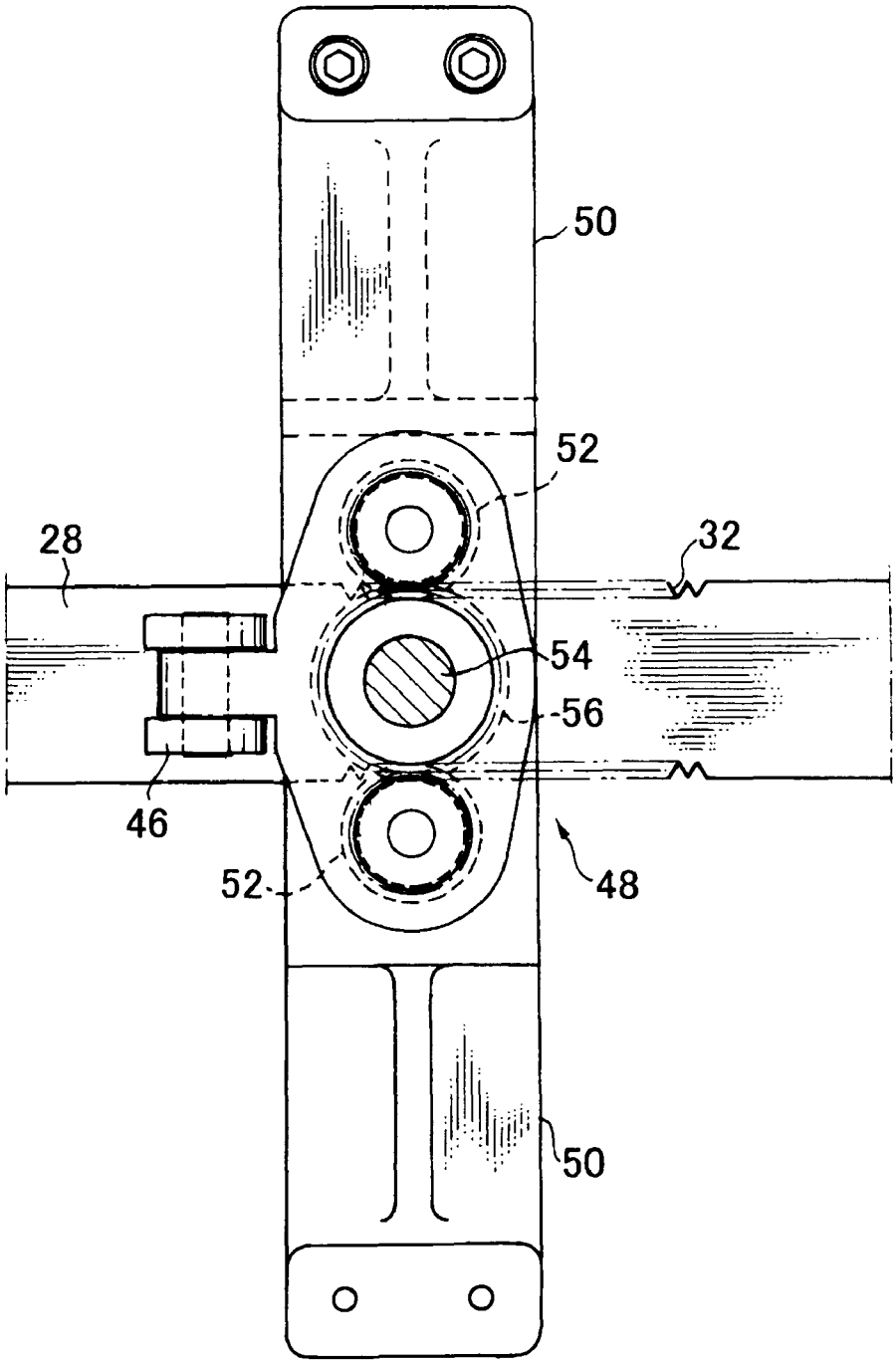
FIG. 4 is a plan view from an arrow IV in FIG. 3.

Rack portion 32 of operation shaft 28 is introduced into support box 48 which is provided at optional position in the axial direction of cylinder with the guidance of a pair of support bearings 46. Desired number of such support box 48 may well be provided at optional position in the axial direction of cylinder, for instance, in compliance with cylinder width and support stem 50 is fixed to the cylinder. (FIG. 4 is a plan view from an arrow IV in FIG. 3)

In support box 48, rotation-free pinion gear 52 engages with rack 32 of operation shaft 28 and the gear 52 further engages with gear 56 at the end of adjustment shaft 54.

As mentioned before, two set of pinion gear 52 and adjustment shafts 54 are provided symmetrically in support box 48 (FIG. 3) in case sheet transfer cylinder 10 is double-sized.

Figure 6:
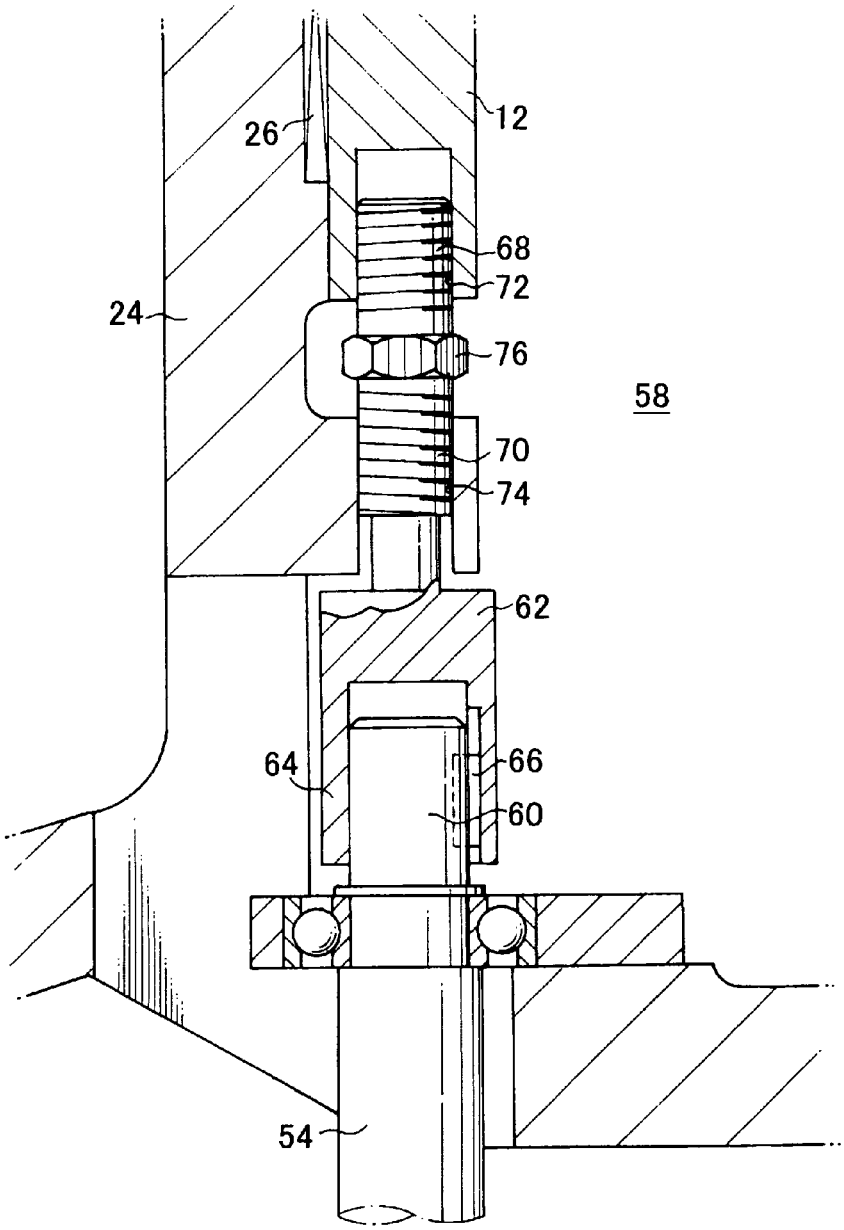
FIG. 6 is an enlarged view showing an example of rotation displacement means.

As shown in FIGS. 3 and 6 (an enlarged view showing an example of rotation displacement means 58), adjustment shaft is rotary provided in the radial direction of cylinder and receives drive force from rack 32 by gear 56 at one end and is in conjunction with gripper-base bar 12 by way of rotation displacement means 58 at the other end.

The rotation displacement means 58 is by screw mechanism and the upper insert portion 60 of adjustment shaft 54 is fit in the lower insert portion 64 of screw-base 62 and is coupled by key 66. Thereby, screw-base 62 is united with adjustment shaft 54 in the rotational direction, slide-free in the vertical direction.

The screw-base 62 has the first male screw portion 68 at the upper half and the second male screw portion 70 at the lower half whose threads are oppositely directed. The first male screw portion 68 at the upper half is in conjunction with female screw portion 72 of gripper-base bar 12 and the second male screw portion 70 at the lower half is in conjunction with female screw portion 74 at the wall surface 24 of cylinder 10.

In the middle of two male screw portions 68, 70, hexagonal tool receiving portion 76 is formed for the convenience of assembly and adjustment by a tool such as by a wrench.

Rotation force brought by adjustment shaft 54 through rotation displacement means 58 of screw mechanism is transmitted to screw-base 62. As the screw-base 62 is rotated together, but slide-free in the vertical direction, consequently, linear displacement of twice of screw pitch is brought to gripper-base bar 12 so as to adjust the height of gripper-base 22 in the radial direction of cylinder.

Therefore, in case height adjustment of gripper-base 22 is needed in compliance with the change of sheet thickness, drive means 44 is activated so as to move the operation shaft 28 in the axial direction of cylinder by way of crank arm 40 and rotation engagement portion 36.

In this case, there is no need for recognition of level position, as drive means 44 and operation shaft 28 are ordinarily engaged.

Linear movement of operation shaft 28 is transformed into drive force of adjustment shaft 54 through rack 32, pinion gear 52 and gear 56 of adjustment shaft 54.

Rotation of adjustment shaft 54 results in the height displacement of gripper-base bar 12 in the radial direction of cylinder by way of rotation displacement means 58 which is connected to the end of shaft 54 and, eventually, height adjustment of gripper-base 22 is realized.

Such height adjustment of gripper-base 22 can exactly be performed, because the amount of adjustment for gripper-base bar 12 through rotation of adjustment shaft 54 and rotation displacement means 58 is minute in comparison with that of movement of operation shaft 28 in the axial direction of cylinder.

The present invention is not limited to the embodiment described above; it can be extended and modified variously.

DESCRIPTION OF THE REFERENCE NUMERALS

12 gripper-base bar
16 cylinder axis
22 gripper-base
28 operation shaft
32 rack portion
34 coupling portion
36 rotational engagement portion
44 drive means
48 support box
52 pinion gear
54 adjustment shaft
56 gear
58 rotation displacement means
62 screw-base
66 key
68 first male screw portion
70 second male screw portion

What is claimed is:

1. An apparatus for adjusting a gripper-base height of a sheet-fed printing press, comprising:

an operation shaft 28 at least partly within a cylinder, said operation shaft 28 being co-centered with a cylinder axis 16 of said cylinder and being movable in the axial direction of said cylinder;

said shaft being equipped with a rack portion 32 at an optional position in the axial direction of said cylinder and a rotation engagement portion 36 at an extruded end of said cylinder along the cylinder axis;

an adjustment shaft 54 which is rotary, provided at the optional position in the axial direction of said cylinder to the radial direction and is rotated upon receiving force from said rack portion 32;

said shaft 54 being connected by way of rotation displacement means 58 to a gripper-base bar 12 to a gripper-base 22 which is adjustably provided in the radial direction; and drive means 44 which is connected to said rotation engagement portion 36 and moves said operation shaft 28 in the axial direction of said cylinder.

2. The apparatus for adjusting gripper-base height according to claim 1, wherein one or a plurality of pinion gears 52 is provided in a support box 48, engaging with said rack portion 32 of said operation shaft 28 and a gear 56 of said adjustment shaft 54.

3. The apparatus for adjusting a gripper-base height according to claim 1, wherein a coupling portion 34 is provided on the way of said operation shaft 28.

* * * * *